US008051676B2

(12) United States Patent
Lin

(10) Patent No.: US 8,051,676 B2
(45) Date of Patent: Nov. 8, 2011

(54) MODULAR SETTING DIAMOND JEWELRY

(75) Inventor: Tian-Wei Lin, Shenzhen (CN)

(73) Assignee: Shenzhen Y & M Industrial Co., Ltd., Shenzhen (CN)

( * ) Notice: Subject to any disclaimer, the term of this patent is extended or adjusted under 35 U.S.C. 154(b) by 0 days.

(21) Appl. No.: 12/778,188

(22) Filed: May 12, 2010

(65) Prior Publication Data

US 2010/0229598 A1 Sep. 16, 2010

Related U.S. Application Data

(63) Continuation of application No. 11/959,620, filed on Dec. 19, 2007, now Pat. No. 7,762,104.

(30) Foreign Application Priority Data

Aug. 31, 2007 (CN) ..... 2007 1 0076738

(51) Int. Cl.
*A44C 17/02* (2006.01)

(52) U.S. Cl. ..... 63/28; 63/27

(58) Field of Classification Search ..... None
See application file for complete search history.

(56) References Cited

U.S. PATENT DOCUMENTS

| | | | |
|---|---|---|---|
| 496,796 | A | 5/1893 | Remlinger |
| 1,238,721 | A | 8/1917 | Birnbaum |
| 1,252,966 | A | 1/1918 | Suderov |
| 1,276,132 | A | 8/1918 | Suderov |
| 1,330,993 | A | 2/1920 | Whitehouse |
| 1,351,205 | A | 8/1920 | Birnbaum |
| 1,421,339 | A | 6/1922 | Zalowitz |
| 2,774,231 | A | 12/1956 | Peterson |
| D505,092 | S | 5/2005 | Kothari |
| D505,093 | S | 5/2005 | Kothari |
| D558,637 | S | 1/2008 | Riesenberg |
| D568,778 | S | 5/2008 | Chan |
| 7,461,452 | B1 | 12/2008 | Kothari |
| 2007/0234758 | A1 | 10/2007 | Mehta |
| 2009/0056376 | A1 | 3/2009 | Lin |

*Primary Examiner* — Jack W. Lavinder

(74) *Attorney, Agent, or Firm* — Buchanan Ingersoll & Rooney, P.C.

(57) ABSTRACT

A modular setting diamond jewelry includes a noble metal base with the bottom thereof being in a shape of taper. A plurality of diamond holes is defined in the top of the noble metal base for receiving diamonds therein. A protrusion is formed between each two adjacent diamond holes which locate at the circumference of noble metal base. The peripheral setting diamonds abut against the central diamond with inner edges thereof. The outer edge of each peripheral diamond is aligned to the peripheral edge of the noble metal base. One diamond hole is defined in the center of the noble metal base, and eight diamond holes are defined around the central diamond hole. The modular setting diamond jewelry of the present invention is ready to make with low cost, since the diamond holes defined in the noble metal base and the protrusions formed between the peripheral diamond holes can install several diamonds and the diamonds together with the noble metal base form an artistic whole to have the same effect as a big grain diamond.

16 Claims, 2 Drawing Sheets

MODULAR SETTING DIAMOND JEWELRY

The present application is a continuation of U.S. Ser. No. 11/959,620, which was filed in the United States on Dec. 19, 2007, now U.S. Pat. No. 7,762,104, and which claims the priority of CN 200710076738.6, which was filed in China on Aug. 31, 2007. The entire contents of U.S. Ser. No. 11/959, 620 and CN 200710076738.6 are incorporated herein by reference.

BACKGROUND OF THE INVENTION

1. Field of the Invention

The present invention relates to a jewelry, particularly relates to a modular setting diamond jewelry.

2. Description of the Related Art

The current diamond resource is more and more scarce. The quantity of small-scale diamond is relatively great, but the small-scale diamond is hard to meet the customer's requirement to wear a large-scale diamond. The conventional product combined with diamonds is usually made manually through bending several long claws to fix the diamonds, which is time-consuming. Furthermore, the aspect of the product depends on human's handicraft, which often results in poor aspect.

The current large-scale diamond such as more than 1 carat diamond is expensive, which cannot satisfy the demand in the low- and middle-end market. The conventional array of several diamonds around one diamond is only to show a pattern of the jewelry. However, and the array of several diamonds around one diamond cannot show the style of a whole grain diamond.

Therefore, the present technology needs to be improved and developed.

SUMMARY OF THE INVENTION

An object of the present invention is to provide a modular setting diamond jewelry which is ready to assemble without bending operation and looks like a whole grain diamond after assembly and can be mounted to any other jewelry.

To achieve the above object, a modular setting diamond jewelry includes a noble metal base with the bottom thereof being in a shape of taper. A plurality of diamond holes is defined in the top of the noble metal base for receiving diamonds therein. A protrusion is formed between each two adjacent diamond holes which locate at the circumference of noble metal base. The peripheral setting diamonds abut against the central diamond with inner edges thereof. The outer edge of each peripheral diamond is aligned to the peripheral edge of the noble metal base.

According to one embodiment of the invention, a jewelry setting includes a metal base having a convex main surface; a central hole and a plurality of outer holes equally spaced around the central hole extend into the main surface; a protrusion projects from the main surface at an outer periphery of the metal base between each of the outer holes; and there are no other supporting projections from the main surface between the outer holes and the central hole.

According to another embodiment of the invention, a jewelry item includes a metal base having a main surface; a central hole and a plurality of outer holes equally spaced around the central hole extend into the main surface; a metal structure for fixing a diamond projects from the main surface at an outer periphery of the metal base between each of the outer holes; a diamond having a girdle mounted in the central hole and a diamond having a girdle mounted in each of the outer holes, wherein the girdle of each of the diamonds in the outer holes rests on top of and engages the girdle of the diamond in the central hole; there are no other supporting projections from the main surface between the outer holes and the central hole.

Wherein one diamond hole is defined in the center of the noble metal base, and eight diamond holes are defined around the central diamond hole.

The modular setting diamond jewelry of the present invention is ready to make with low cost, since the diamond holes defined in the noble metal base and the protrusions formed between the peripheral diamond holes can install several diamonds and the diamonds together with the noble metal base form an artistic whole to have the same effect as a big grain diamond.

Other objects, advantages and novel features of the present invention will be drawn from the following detailed embodiment of the present invention with attached drawings, in which:

DETAILED DESCRIPTION OF THE PREFERRED EMBODIMENTS

Figure 1:
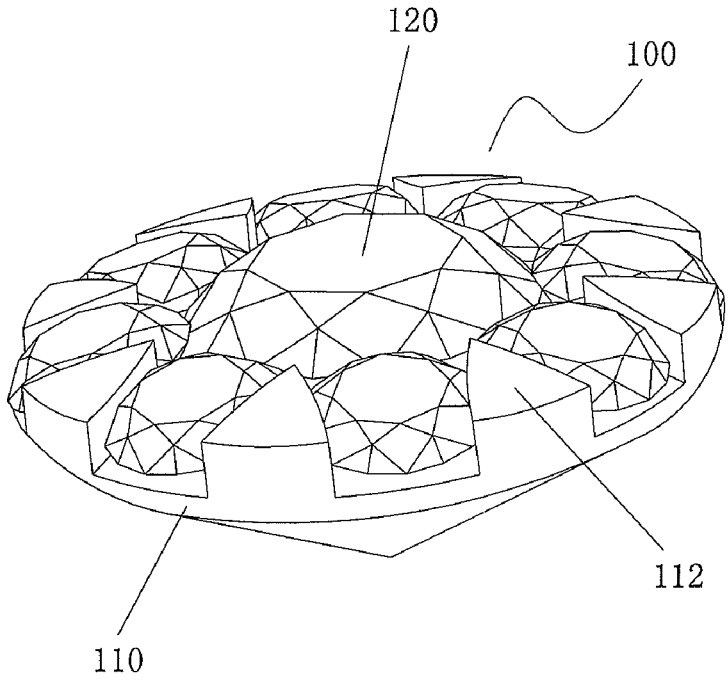
FIG. 1 is a perspective view of a modular setting diamond jewelry of the present invention.
Figure 2:
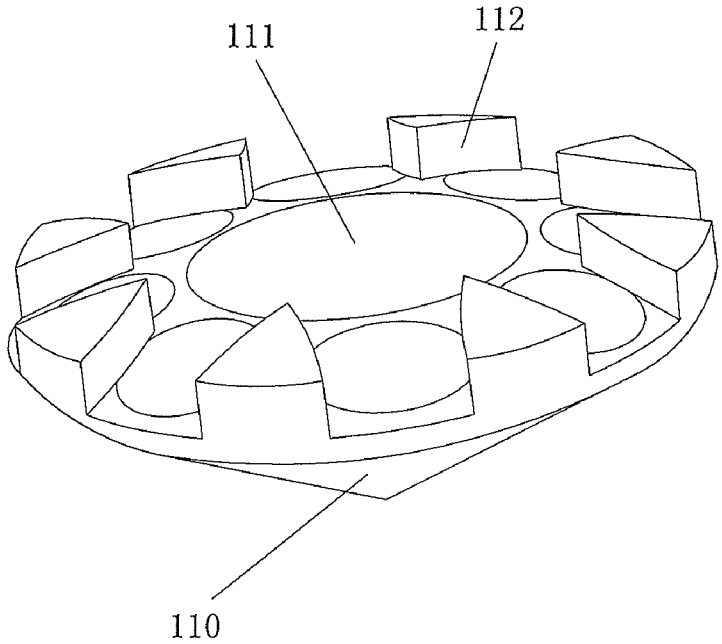
FIG. 2 is a perspective view of a noble metal base of the present invention.

Referring to FIG. 1, a modular setting diamond jewelry 100 of the present invention includes a noble metal base 110. As shown in FIG. 2, the bottom of the noble metal base 110 is in a shape of taper. A plurality of diamond holes 111 is defined in the top of the noble metal base 110 for respectively receiving diamonds 120. The noble metal base 110 can be made by various noble metals, for example, gold, silver, platinum and alloy thereof and so on. A protrusion 112 is formed between each two adjacent diamond holes 111 which locate at the circumference of noble metal base 110. Each protrusion 112 is triangular and the protrusion 112 becomes wider outwardly along a radial direction. Thus different sizes of diamonds may be adapted to set between two protrusions 112, and does not need to manually bending a claw.

In the preferable embodiment of present invention, one diamond hole 110 is defined in the center of the noble metal base, and eight diamond holes 110 are defined around the central diamond hole 110. Of cause, the diamond holes 110 may be defined in other forms, for example, one in center, six around the center and so on. Therefore, the quantity of the diamond holes 110 of the present invention is not limited and more than one diamond holes 110 around the central diamond hole 110 can achieve the object of the present invention.

Figure 3:
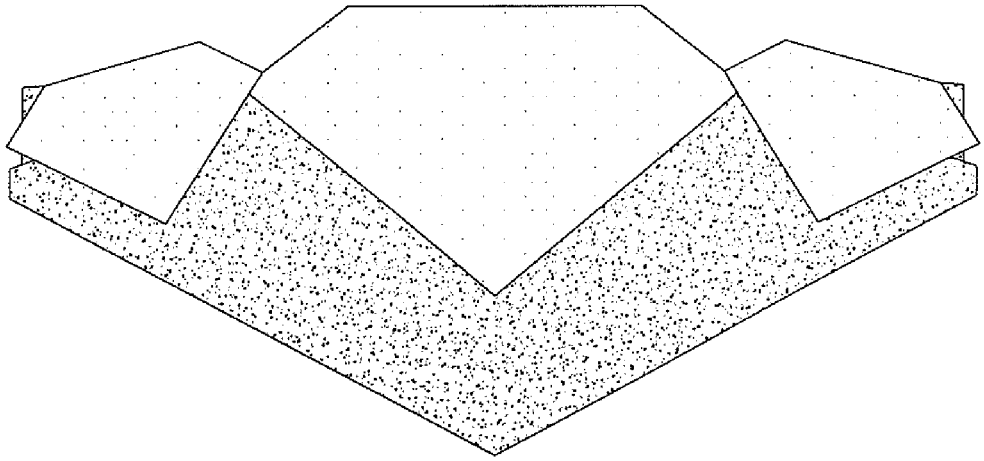
FIG. 3 is a cross-sectional view of FIG. 1.

As shown in FIG. 3, in assembly, the peripheral setting diamonds abut against the central diamond with edges thereof. The outer edge of each peripheral diamond is aligned to the peripheral edge of the noble metal base. Moreover the bottom surface of the noble metal base is tapered. Therefore, after assemble, as a whole, the modular setting diamond jewelry resembles extremely with a whole grain diamond, but its cost reduces greatly. Thus, the modular setting diamond jewelry of the present invention can have the decoration effect of the big grain diamond with low cost.

At the same time, the modular setting diamond jewelry of the present invention can be used to completely simulate a whole grain diamond. Furthermore, the size of the modular setting diamond jewelry is changeable. So the modular setting diamond jewelry can be formed to be different standard parts thereby forming a series of product. Thus, the modular setting diamond jewelry is similar to a whole grain diamond to mount on any other jewelry, such as diamond ring, necklace and so on. Therefore, the modular setting diamond jewelry of the present invention can be as adapted to any position which the whole grain diamond is used, and so has an extremely profitable market value.

The modular setting diamond jewelry of the present invention is ready to make, since the diamond holes defined in the noble metal base and the protrusions formed between the peripheral diamond holes can install several diamonds and the diamonds together with the noble metal base form an artistic whole. The modular setting diamond jewelry of the present invention may be formed to be the series product as the single diamond to be assembled on other necklaces or the diamond ring, and has the completely same effect as a big grain diamond. Therefore, the modular setting diamond jewelry of the present invention can achieve the effect a bigger diamond with low cost and so has profitable market potential.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A jewelry setting, comprising:

a metal base having a convex main surface;

a central hole and a plurality of outer holes equally spaced around the central hole extend into the main surface;

a protrusion projects from the main surface at an outer periphery of the metal base between each of the outer holes; and there are no other supporting projections from the main surface between the outer holes and the central hole.

2. The jewelry setting of claim 1, wherein the metal base is a noble metal.

3. The jewelry setting of claim 1, wherein the wedges are triangular.

4. The jewelry setting of claim 1, wherein the metal base has a bottom in the shape of a taper.

5. The jewelry setting of claim 1, wherein each protrusion is a wedge projecting from the convex main surface at the outer periphery of the metal base between each of the outer holes, said wedges tapering such that a broad end of the wedge is at the outer periphery and a narrow end of the wedge faces toward a center of the metal base.

6. The jewelry setting of claim 1, wherein the convex main surface is arcuate.

7. A jewelry item, comprising:

a metal base having a main surface;

a central hole and a plurality of outer holes equally spaced around the central hole extend into the main surface;

a metal structure for fixing a diamond projects from the main surface at an outer periphery of the metal base between each of the outer holes;

a diamond having a girdle mounted in the central hole and a diamond having a girdle mounted in each of the outer holes, wherein the girdle of each of the diamonds in the outer holes rests on top of and engages the girdle of the diamond in the central hole;

there are no other supporting projections from the main surface between the outer holes and the central hole.

8. The jewelry item of claim 7, wherein the metal base is a noble metal.

9. The jewelry item of claim 7, wherein the wedges are triangular.

10. The jewelry item of claim 7, wherein the main surface is substantially flat.

11. The jewelry item of claim 7, wherein the metal base has a bottom in the shape of a taper.

12. The jewelry item of claim 7, wherein the metal structures for fixing a diamond are wedges, said wedges tapering such that a broad end of the wedge is at the outer periphery and a narrow end of the wedge faces toward a center of the metal base.

13. The jewelry item of claim 7, wherein the main surface is convex.

14. The jewelry item of claim 7, wherein the diamond in the central hole is larger than the diamonds in the outer holes.

15. The jewelry item of claim 14, wherein a top surface of the diamond in the central hole sits higher than a top surface of the diamonds in the outer holes.

16. The jewelry item of claim 7, wherein a top surface of the diamond in the central hole sits higher than a top surface of the diamonds in the outer holes.

* * * * *